United States Patent [19]

Amann et al.

[11] 3,968,660

[45] July 13, 1976

[54] COOLING ARRANGEMENT FOR A NO-FROST REFRIGERATOR

[75] Inventors: Klaus Amann; Wolfgang Dienemann, both of Giengen, Germany

[73] Assignee: Bosch-Siemens Hausgerate GmbH, Munich, Germany

[22] Filed: June 28, 1974

[21] Appl. No.: 484,334

[30] Foreign Application Priority Data

June 29, 1973 Germany ..... 2333158

[52] U.S. Cl. ..... 62/275; 62/80; 62/97; 62/419; 165/48; 165/64; 165/108

[51] Int. Cl.[2] ..... F25D 21/04; F25D 17/06

[58] Field of Search ..... 165/30, 64, 48, 108; 62/419, 93, 275, 80, 90, 97

[56] References Cited

UNITED STATES PATENTS

| | | | |
|---|---|---|---|
| 3,050,956 | 8/1962 | Mann et al. | 62/275 X |
| 3,126,716 | 3/1964 | De Witte | 62/275 X |
| 3,393,530 | 7/1968 | Koch | 62/275 |
| 3,495,416 | 2/1970 | Morrissey, Jr. et al. | 62/275 X |
| 3,756,038 | 9/1973 | MacMaster et al. | 62/275 X |

*Primary Examiner*—Albert W. Davis, Jr.
*Assistant Examiner*—Sheldon Richter
*Attorney, Agent, or Firm*—Michael J. Striker

[57] ABSTRACT

A cooling arrangement, particularly for a no-frost refrigerator, including a heat-insulated housing, containing air; heating means located in said heat-insulating housing for heating a portion of said air; cooling means located in said heat-insulating housing for cooling a portion of said air; and air guiding means for mixing at least a portion of the heated air with a portion of the cooled air.

7 Claims, 3 Drawing Figures

COOLING ARRANGEMENT FOR A NO-FROST REFRIGERATOR

BACKGROUND OF THE INVENTION

The invention relates to a cooling apparatus or arrangement, particularly for a no-frost refrigerator utilizing air recirculation.

It is already known to provide a refrigerator with a heat-insulating housing, and with two compartments at different temperatures, such as for example, a food-storage compartment and a freezer compartment. It is also known to equip the freezer compartment with an evaporator and air guiding means for circulating the air through the evaporator and into the compartments of the refrigerator. The evaporator in fact may form one wall of the freezer compartment. Means such as canals, channels, passageways or the like may be provided to circulate the air from one compartment to another to effect the mixing of the air from the compartment with the relatively higher operating temperature with the air from the colder compartment.

With the arrangements as found in the presently known refrigerators, the relatively warm and moist air from the compartment with the higher operating temperature is passed directly through a communication channel to the compartment with the lower operating temperature and mixed with the considerably colder air. The result of the mixing in the chamber with the lower temprature is the condensation of the moisture in the air to form a fog or mist. As a result, frost or ice may form, interfering with the operation of the refrigertor. Under unfavorable circumstances, such great quantities of snow or frost could form in the compartment with the lower temperature that it would cover the goods placed in the freezer compartment. Furthermore, the misty air is blown over the ventilator and through various channels or passages, where frost may form, thereby hindering the air current flow or shutting it off entirely. With an extremely high moisture content in the compartment with the higher operting temperture, the formation of frost and snow could be so intense that the operation of the refrigerator may no longer be possible after a short operating time.

SUMMARY OF THE INVENTION

It is an object of the invention to provide a cooling arrangement for a no-frost refrigerator which overcomes the disadvantages of the prior art.

It is another object of the invention to provide a cooling arrangement for a two compartment refrigerator in which air from the compartment with the relatively higher operating temperature is heated and dried before mixing with the air in the compartment with the relatively lower operating temperature.

It is another object of the invention to provide a cooling arrangement, including a heating device for raising the temperature of the relatively warm and moist air from the compartment with a higher operating temperature prior to mixing the air with the relatively colder air in the other compartment of the refrigerator.

It is a further object of the invention to provide a cooling arragement, particularly for a no-frost refrigerator, comprising a heat-insulated housing containing air; heating means located in said heat-insulating housing for heating a portion of said air; cooling means located in said heat-insulated housing for cooling a portion of said air; and air guiding means for mixing at least a portion of said heated air with a portion of said cooled air.

By heating the air from the compartment with the relatively higher operating temperature, the relative moisture in the air is lowered, and therefore the air is in effect dried. The resulting mixture of this air with air from the relatively cooler compartment will result in an air mixture having moisture and temperature parameters which lie below the saturation level of the air, and thereby the formation of fog, mist or frost is prevented.

According to the principle of the present invention, the heating means is an electrical heating device such as, preferably, an electrical resistance coil, intermittently operable with the air guiding means. Thus, the heating element would be operated only when the fan and motor is in operation to draw the air from one compartment to another compartment. In this manner, heating of the vicinity of the heating element is prevented when the air circulating means is cut off.

A particularly simple arrangement according to the principles of the present invention is to place the air circulator means, such as the fan and operational motor, adjacent to the outlet of the passageway between the two compartments, and also adjacent to the heating element.

In another embodiment of the invention, it is possible to eliminate the heating element entirely and utilize solely the heat from the operating motor for recirculation of the air. In this particular embodiment, the motor is situated closely adjacent to the passageway between the two compartments, so that the air flows over and around the elements of the motor, thereby being heated up. This method is particularly advantageous in saving energy.

The novel features which are considered as characteristic for the invention are set forth in particular in the appended claims. The invention itself, however, both as to its construction and its method of operation, together with additional objects and advantages thereof, will be best understood from the following description of specific embodiments when read in connction with the accompanying drawing.

DESCRIPTION OF THE PREFERRED EMBODIMENTS

Figure 1:
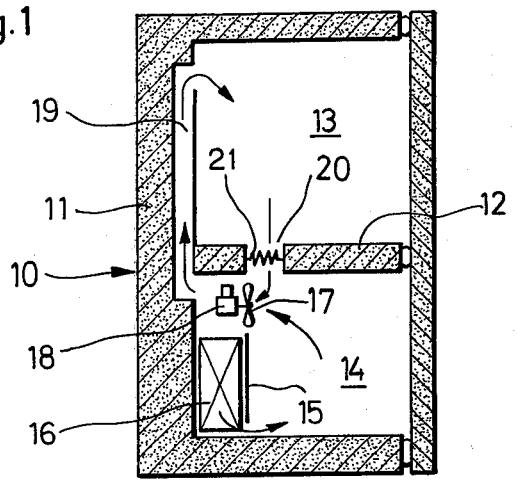
FIG. 1 is a side cross-sectional view of a no-frost refrigerator, in a first embodiment as taught by the present invention, including a heating element within a recirculating air outlet.

FIG. 1 is a highly simplified vertical section through a no-frost refrigerator. There is shown a heat insulated housing 11, with two separate compartments 13, 14, separated by a heat insulating horizontal partition 12. At the upper side of the heat-insulating partition 12 is located a compartment 13 which serves as the storage or refrigeration compartment. The storage compartment 13 operates at a higher temperature than the freezing compartment 14, located below the partition 12. In front of the rear wall of the freezer compartment 14 is an evaporator 16, forwardly of which is a cover or shield 15. The construction and operation of the evaporator 16 are well known to those skilled in the art and are therefore not described or shown in any significant detail in the Figure. Closely underneath the heat insulating partition 12 and above the evaporator 16 is an air recirculating device or fan 17, driven by a motor 18. By means of this ventilating fan 17 the enclosed air in the cooling apparatus will be blown in the directions of the arrows shown in FIGS. 1 and 2.

In the rear wall of the housing 11 is an air channel 19 for the passage of cooled air from the freezing compartment 14 to the storage compartment 13, thereby cooling the stored goods in the compartment and removing the warm and moist air therefrom. In the heat insulating partition 12 there is an air passageway 20 located in the vicinity of the evaporator 16 and connecting the storage compartment 13 with the freezer compartment 14. In the passageway 20 for the circulation of air from the storage compartment 13 is located a heating device 21. The heating device serves to heat the relatively warm and moist air to a higher temperature, and thereby dry the air in a well known manner. The heating device 21 is constructed of an electrical resistance element and is operated intermittently with the air circulating device, where the air circulating device is switched on or off, by well-known temperature control means the electrical current supplied to the heating device will likewise be switched on or off, respectively. In other words the air-circulating device and the heating device are both concurrently actuated and deactuated.

Figure 2:
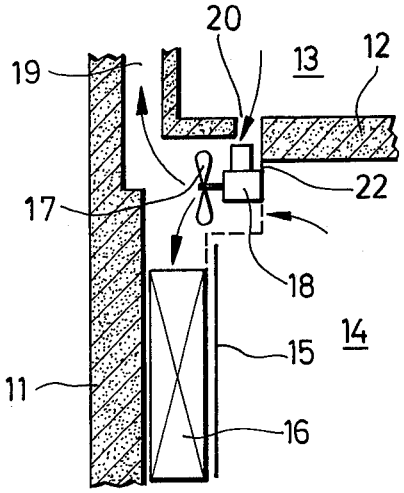
FIG. 2 is a highly simplified portion of a side cross section of a no-frost refrigerator, with motor for air recirculation as the heating element, in a second embodiment according to the present invention.

FIG. 2 shows a second embodiment of the arrangement according to the present invention, in which the same numerals refer to corresponding parts as in FIG. 1. The fan 17 with its operational motor 18 is so arranged so that its exothermal parts, particularly its covering members, are situated near the outlet of the passageway 20 in the heat-insulated partition 12. In this manner the air guiding arrangement 22 permits the air which is sucked from the upper compartment 13 through the partition 12 to be mixed with the cold air coming from the freezer compartment 14. Thus, the air passing over and through the operational motor would be heated and dried. The air flow is again shown by arrows; air flows from the upper compartment 13 through the passage 20 and over the motor 18 and through the fan 17, thereby absorbing a portion of the motor heat. By this means the air will be heated and the relative moisture content of the air lowered. A separate heating element is not necessary in this embodiment.

Figure 3:
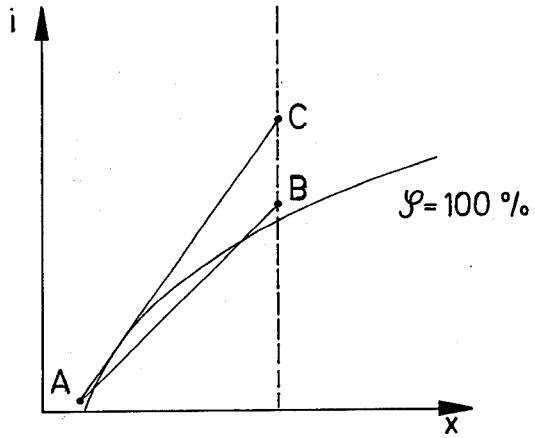
FIG. 3 is a diagram representing i and x axes, corresponding to temperature and moisture, respectively, of the air in the refrigerator.

FIG. 3 illusrates a diagram with i and x axes representing temperature and absolute moisture content of the air, respectively. The air in the freezer compartment is represented by the point labeled A, that is, as having relatively low temperature and moisture. The air in the storage compartment being relatively warmer and moister, is represented by the point B. With the mixing of both air masses from the storage compartment and the freezer compartment, the resulting mixed air will have a temperature and moisture content represented by some particular point on the line connecting points A and B. If the air is mixed without preparatory heating and drying there is a large probability that the resulting temperature and moisture parameters would lie between the saturation curve $\phi = 100\%$ and the abscissa of the diagram, thereby resulting in the formation of a so-called foggy region. It is also possible that the mixing process will result in the formation of snow or frost in certain regions, which is desired to be overcome by a no-frost refrigerator. Through the heating and warming of the recirculating air coming from the storage compartment, the absolute moisture content $x$ of the air is kept constant, while the temperature $i$ is raised. Therefore, as a result of the heating operation, the portion of air formerly at a temperature and a moisture represented by point B will now have the temperature and moisture represented by point C in the diagram in FIG. 3. The relative moisture content of the air is thereby lowered, and the diagram clearly indicates that the line connecting points C and A lies above and does not intersect the saturation line $\phi = 100\%$. The formation of frost or snow is, therefore, prevented by the technique of the present invention.

It will be understood that each of the elements described above, or two or more together, may also find a useful application in other types of cooling arrangements differing from the types described above.

While the invention has been illustrated and described as embodied in a frost-free refrigerator, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A cooling arrangement, particularly for a no-frost refrigerator, comprising a heat-insulating housing containing air in a first zone in which the air is relatively warmer and more humid, and in a second zone in which the air is relatively cooler and less humid; passage means including a mixing region for conducting at least a portion of the more humid air from said first zone towards said second zone and to said mixing region; mixing means for causing said portion of humid air from said first zone to be mixed with the air in said second zone; and means for heating and lowering the relative moisture content of said portion of humid air from said first zone prior to the mixing by said mixing means, so that the formation of fog and ice in said mixing region is prevented, said heating means comprising a motor associated with said mixing means.

2. A cooling arrangement as defined in claim 1, and further comprising cooling means including an evaporator.

3. A cooling arrangement as defined in claim 1, wherein said housing includes two compartments, each of said compartments defining one of said zones.

4. A cooling arrangement as defined in claim 3, wherein said relatively warmer compartment is a food-storage compartment, and said relatively cooler compartment is a freezer compartment.

5. A cooling arrangement as defined in claim 3, wherein said two compartments are separated by a partition comprising an air passageway between said two compartments.

6. A cooling arrangement as defined in claim 5, wherein said heating means is located in said passageway.

7. A cooling arrangement as defined in claim 5, wherein said passage means directs the air from the relatively warmer compartment to the relatively colder compartment through said passageway.

* * * * *